United States Patent [19]

Sheeler et al.

[11] 4,357,155

[45] Nov. 2, 1982

[54] SINGLE-COLLET, DUAL-PACKAGE WINDER WITH SELF-THREADING REAR SECONDARY STRAND GUIDE

[75] Inventors: Scott O. Sheeler, Newark, Ohio; Howard B. Bush; Peter N. Kiproff, both of Jackson, Tenn.

[73] Assignee: Owens-Corning Fiberglas Corporation, Toledo, Ohio

[21] Appl. No.: 298,715

[22] Filed: Sep. 2, 1981

[51] Int. Cl.[3] ..... C03B 37/025

[52] U.S. Cl. ..... 65/10.1; 242/18 G

[58] Field of Search ..... 65/1, 2, 10, 10.1, 11.1; 242/18 G

[56] References Cited

U.S. PATENT DOCUMENTS

| | | | |
|---|---|---|---|
| 3,810,742 | 5/1974 | Klink et al. | 65/10.1 X |
| 4,192,663 | 3/1980 | Schmandt et al. | 65/10.1 X |
| 4,230,284 | 10/1980 | Cunningham et al. | 242/18 G |

*Primary Examiner*—Robert L. Lindsay, Jr.

*Attorney, Agent, or Firm*—Ronald C. Hudgens; Greg Dziegielewski; Paul J. Rose

[57] ABSTRACT

In strand forming and packaging apparatus including a molten glass stream feeder and a single-collet, dual-package winder, cam and hook means are provided between the front and rear secondary shoe means to effect automatic threading of the rear strand into the rear secondary shoe means when the operator moves the front and rear strands into operative association with the collet and threads the front strand into the front secondary shoe means.

5 Claims, 7 Drawing Figures

SINGLE-COLLET, DUAL-PACKAGE WINDER WITH SELF-THREADING REAR SECONDARY STRAND GUIDE

TECHNICAL FIELD

This invention relates generally to continuous filament strand forming and packaging apparatus, and more particularly to a single-collet, dual-package winder having a self-threading rear secondary shoe or strand guide.

BACKGROUND ART

In the formation of glass fibers from molten glass streams supplied by a feeder or bushing, the attenuation of the streams into fibers and the packaging of the fibers as glass strand may be accomplished with a single-collet, dual-package winder. In such a system, the fibers from two halves of the bushing are gathered into two strands respectively by a pair of primary shoes after being drawn over a dual sizing applicator roll, or respectively over a pair of sizing applicator rolls, and the two strands are wound into two packages on the collet after passing respectively through a pair of secondary shoes and over a pair of conventional helical wire package builders. When the packages are complete, the operator shuts off the winder, breaks the strands from the completed packages, and inserts the strands from the primary shoes temporarily between a pair of pull rolls offset from the secondary shoes, thereby removing the strands from the secondary shoes. The pull rolls pull the fibers from the bushing to prevent flooding thereof and the scrap strand generated is fed to a lower level through a hole in the floor while the operator removes the completed packages from the collet and places empty paper tubes thereon. With the empty paper tubes in place, the operator turns on the winder, removes the strands from the pull rolls, and threads the strands temporarily into a groove on the front end of the collet until the linear speed of the strands is increased from the slow speed in the pull rolls to proper winding speed. Then the operator pushes the strands along the collet to move them respectively into operative engagement with the paper tubes and threads them respectively into the pair of secondary shoes above. Prior to our invention, to thread the rear strand into the rear secondary shoe, the operator had to lean dangerously close to the front of the rotating winding collet.

DISCLOSURE OF INVENTION

In accordance with the invention, a bridging cam member is provided between the front secondary shoe and the rear secondary shoe, and a curved wire hook is mounted on the cam member with its free end aligned between the two strands as they travel from the primary shoes to the pull rolls. When the operator disengages the strands from the pull rolls to thread them in the groove at the front of the collet, the rear strand becomes engaged in the hook. After the strands have been brought up to winding speed, the operator moves the strands out of the collet groove into operative engagement respectively with the paper tubes and threads the front strand into the front secondary shoe. The rear strand automatically rides along the hook and across the cam member into the slot of the rear secondary shoe, eliminating the need for the operator to lean dangerously close to the rotating collet.

BRIEF DESCRIPTION OF DRAWINGS

The invention is hereinafter described in greater detail with reference to the accompanying drawings in which.

BEST MODE OF CARRYING OUT THE INVENTION

Figure 1:
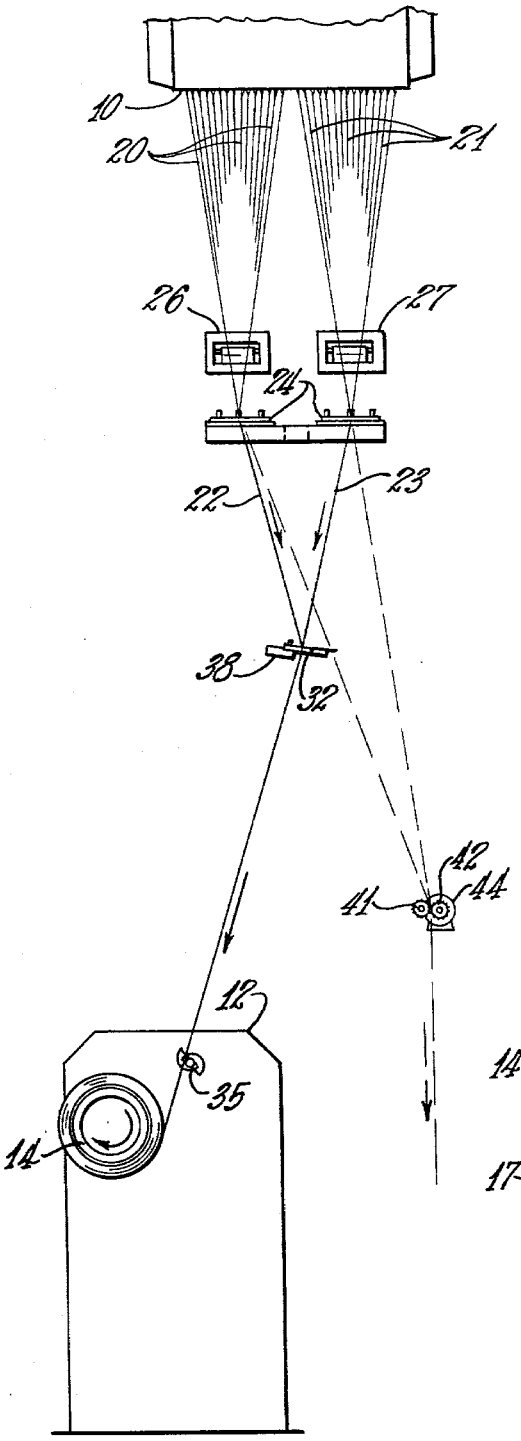
FIG. 1 is a schematic front elevational view of dual strand forming and packaging apparatus including a dual secondary shoe or strand guide constructed in accordance with the invention.
Figure 2:
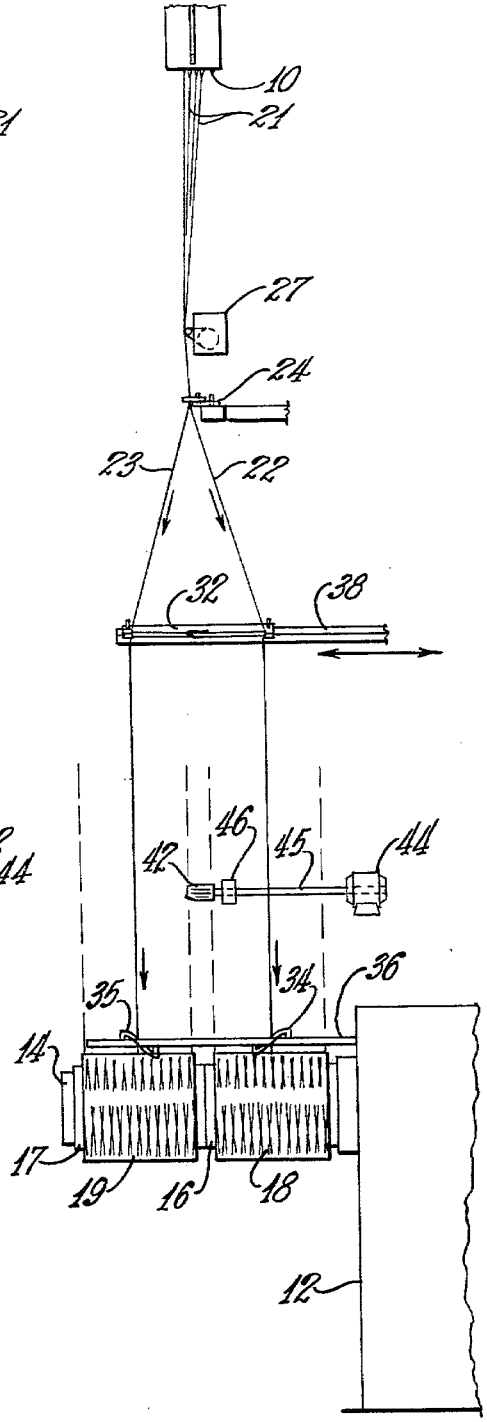
FIG. 2 is a side elevational view of the apparatus of FIG. 1.

With reference to the drawings, FIGS. 1 and 2 show strand forming and packaging apparatus including a molten glass stream feeder or bushing 10 and a single-collet, dual-package winder 12 having a collet 14 with paper tubes 16 and 17 on which rear and front strand packages 18 and 19 are shown in FIG. 2 in the process of being wound. The winding of the packages 18 and 19 attenuates molten glass streams from two halves of the bushing 10 respectively into two groups of glass fibers or filaments 20 and 21 gathered respectively into a rear strand 22 and a front strand 23 by a dual primary gathering shoe or strand gluide 24 after passing respectively over the rolls of a pair of conventional sizing applicators 26 and 27. A single longer sizing applicator may be used in place of the applicators 26 and 27.

From the dual primary shoe 24, the strands 22 and 23 pass respectively through a rear secondary shoe 30 and a front secondary shoe 31 (FIG. 3) of a reciprocally mounted and driven dual secondary shoe or strand guide assembly 32 and over a rear helical wire package builder 34 and a front helical wire package builder 35 before being wound respectively into the packages 18 and 19. The helical wire package builders 34 and 35 are constructed and operate essentially as shown in U.S. Pat. No. 2,391,870. A shaft 36 on which the package builders 34 and 35 are mounted is rotatably driven and also reciprocates longitudinally. An elongated support member 38 for the dual secondary shoe assembly 32 reciprocates in unison with the shaft 36.

When the packages 18 and 19 are complete, the operator will break the strands 22 and 23 from the packages and insert them between a pair of pull rolls 41 and 42 rotatably driven by a motor 44. The motor 44 drives a shaft 45 on which the roll 42 is mounted and drives gears in a gear housing 46 to drive a shaft on which the roll 41 is mounted. The pull rolls feed the strands 22 and 23 as scrap through a hole in the floor adjacent the winder 12 while the operator removes the completed packages 18 and 19 from the collet 14 and installs empty paper tubes 16 and 17.

Figure 3:
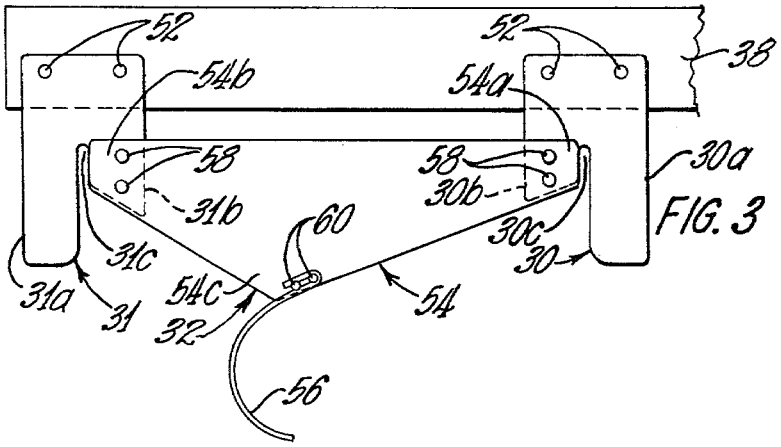
FIG. 3 is essentially a plan view of the dual secondary shoe or strand guide of FIG. 1.

The dual secondary shoe assemblsy 32 mounted on the support member 38 is best shown in FIG. 3 and includes the rear secondary shoe 30, the front secondary shoe 31 spaced from the shoe 30, a bridging cam member 54, and a curved wire hook 56. Each of the shoes 30 and 31 is secured to the support member 38 by a pair of pins 52. The shoe 30 includes a long leg portion 30*a* and a short leg portion 30*b* spaced apart to provide a slot 30*c*. therebetween. Similarly, the shoe 31 includes a long leg portion 31*a* and a short leg portion 31*b* spaced apart to provide a slot 31*c* therebetween. The shoes 30 and 31 are ientical in shape, but reversely positioned to dispose the short leg portions 30*b* and 31*b* closer to each other than the long leg portions 30*a* and 31*a*. The cam member 54 is generally in the shape of an obtuse triangle with truncated acute angle portions 54*a* and 54*b* thereof secured respectively to the short leg portions 30*b* and 31*b* by pairs of pins 58. The curved wire hook 56 is secured to an obtuse angle portion 54*c* of the cam member by a pair of pins 60. The shoes 30 and 31 and the bridging cam member 54 are preferably made of a commercially available cloth reinforced plastic known as Micarta. The curved wire hook 56 is preferably made of brass.

Figure 4:
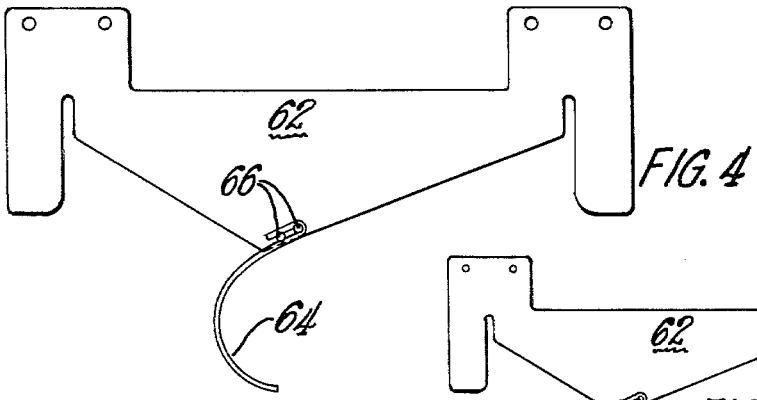
FIG. 4 is essentially a plan view of a modification of the structure of FIG. 3.

FIG. 4 shows a preferred embodiment wherein the shoes 30 and 31 and the cam member 54 of the embodiment of FIG. 3 are all made in a one-piece dual secondary shoe and cam member 62, a curved wire hook 64 being secured to the cam portion thereof by a pair of pins 66.

Figure 5:
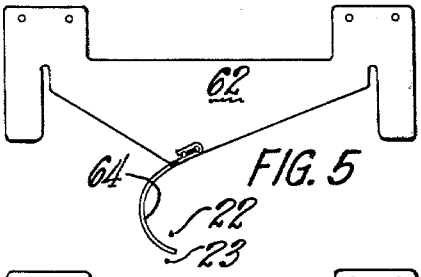
FIG. 5 is essentially a plan view of the structure of FIG. 3 schematically showing the relative positions of the strands thereto in the plane thereof when the strands are traveling from the pair of primary shoes through the pull rolls of the apparatus of FIG. 1.

FIG. 5 schematically illustrates the positions of the strands 22 and 23 with respect to the member 62 and hook 64 when the strands are being pulled by the pull rolls 41 and 42. In actual practice, the front strand 23 is farther away from the hook 64. The rear strand 22 is positioned for entrapment by the hook 64.

Figure 6:
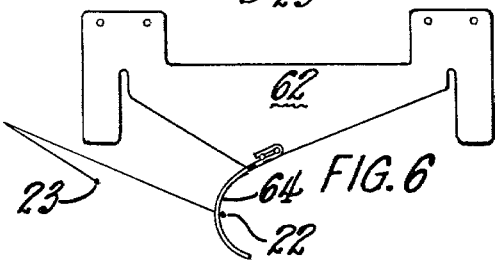
FIG. 6 is essentially a plan view of the structure of FIG. 3 schematically showing the relative positions of the strands thereto in the plane thereof when the strands are traveling from the pair of primary shoes to the groove at the front of the winder collet of the apparatus of FIG. 1.

FIG. 6 schematically illustrates the positions of the strands 22 and 23 with respect to the member 62 and hook 64 after the operator has removed the strands from the pull rolls and initiated the winding thereof on the front end portion of the collet 14 to bring their speed back up to winding speed. The strand 22 is in engagement with the hook 64.

Figure 7:
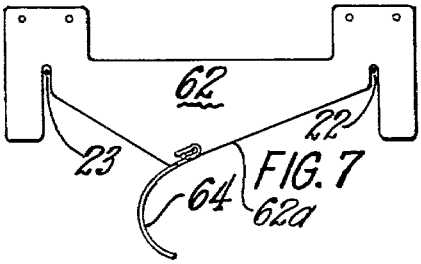
FIG. 7 is essentially a plan view of the structure of FIG. 3 showing the strands respectively in the front and rear secondary shoes after the operator has threaded the front strand in the front secondary shoe and released the rear strand for automatic threading into the rear secondary shoe.

FIG. 7 illustrates the positions of the strands 22 and 23 with respect to the member 62 and hook 64 after the operator has moved the strands 22 and 23 into operative engagement respectively with newly installed paper tubes 16 and 17 on the collet 14 and threaded the front strand 23 into the front secondary shoe portion corresponding to the front secondary shoe 31. The tension in the rear strand 22 caused by the winding thereof on the paper tube 16 induces transverse movement thereof along the hook 64, across a cam face 62*a* of the member 62, and into the rear secondary shoe portion of the member 62 corresponding to the shoe 30. Thus, the rear strand 22 is automatically threaded into the rear secondary shoe without dangerous leaning over the rotating collet 14 by the operator.

Various modifications may be made in the structure shown and described without departing from the spirit and scope of the invention.

We claim:

1. Strand forming and packaging apparatus comprising a molten glass stream feeder, a single-collet, dual-package winder disposed below the feeder for attenuating two sets of molten glass streams respectively from two halves of the feeder into two sets of glass fibers and winding the fibers as front and rear strands respectively into front and rear packages on the collet, primary shoe means disposed between the winder and the feeder for gathering the two sets of glass fibers from the two halves of the feeder respectively into a pair of strands, secondary shoe means disposed between the winder and the primary shoe means and including front secondary shoe means and rear secondary shoe means for orienting the pair of strands from the primary shoe means as the front and rear strands, auxiliary pulling means disposed between the winder and the secondary shoe means and transversely of the collet for temporarily pulling the pair of strands from the primary shoe means and maintaining integrity of the fibers at the feeder while an operator removes completed front and rear packages from the collet and installs front and rear empty paper tubes thereon for the winding of a successive set of front and rear packages, and cam and hook means including cam means extending between the front secondary shoe means and the rear secondary shoe means and a hook on the cam means, whereby when the operator removes the strands from the pulling means and operatively engages them with a front end portion of the collet, only the rear strand is entrapped by the hook, and when the operator moves the strands into operative engagement respectively with the front and rear empty paper tubes on the collet and threads the front strand into the front secondary shoe means, the rear strand is automatically threaded into the rear secondary shoe means by transverse movement along the hook and cam means effected by tension in the strand from the winding thereof on the rear paper tube.

2. Apparatus as claimed in claim 1 wherein each of the front and rear secondary shoe means is provided with a slot for receiving the respective strand, the cam means is generally in the shape of an obtuse triangle with the longest side extending perpendicularly to the slots in the front and rear secondary shoe means and the two shorter sides providing cam surfaces ending respectively at the free end portions of the slots, and the hook is mounted adjacent the obtuse angle of the cam means.

3. Apparatus as claimed in either of claims 1 and 2 wherein the cam means and the front and rear secondary shoe means are made of resin reinforced with layers of woven cloth.

4. Apparatus as claimed in either of claims 1 and 2 wherein the cam means and the front and rear secondary shoe means are made in one piece.

5. Apparatus as claimed in claim 2 wherein each of the front and rear secondary shoe means includes a long leg portion and a short leg portion defining the respective slot, the acute angles of the cam means are truncated, and the cam means is secured at the truncated acute angle portions respectively to the short leg portions of the front and rear secondary shoe means.

* * * * *